US008616401B2

(12) United States Patent
Zolcher

(10) Patent No.: US 8,616,401 B2
(45) Date of Patent: Dec. 31, 2013

(54) CLOSURE FOR A CONTAINER FOR PHARMACEUTICALS

(75) Inventor: Dirk Zolcher, Nideggen (DE)

(73) Assignee: West Pharmaceutical Services Deutschland GmbH & Co. KG, Eschweiler (DE)

( * ) Notice: Subject to any disclaimer, the term of this patent is extended or adjusted under 35 U.S.C. 154(b) by 48 days.

(21) Appl. No.: 13/133,537

(22) PCT Filed: Dec. 4, 2009

(86) PCT No.: PCT/EP2009/008677

§ 371 (c)(1), (2), (4) Date: Jun. 8, 2011

(87) PCT Pub. No.: WO2010/066382

PCT Pub. Date: Jun. 17, 2010

(65) Prior Publication Data

US 2011/0240642 A1 Oct. 6, 2011

(30) Foreign Application Priority Data

Dec. 9, 2008 (DE) ..... 10 2008 060 995

(51) Int. Cl.
*B65D 51/16* (2006.01)
*B65D 41/02* (2006.01)

(52) U.S. Cl.
CPC ..... *B65D 41/023* (2013.01)
USPC ..... 220/378; 215/341

(58) Field of Classification Search
CPC ..... B65D 39/0076; B65D 41/023; B65D 41/026; B65D 41/005; B65D 41/165
USPC ..... 220/203.02, 203.01, 212, 304, 378, 220/377, 265, 305; 215/309, 307, 364, 365, 215/349, 344, 343, 341, 228, 249, 248, 247, 215/297, 200; 53/487, 485, 484, 471, 467; 264/486

IPC ..... B67B 3/24,3/02; B65D 51/16; A61J 1/00
See application file for complete search history.

(56) References Cited

U.S. PATENT DOCUMENTS 2,819,748 A * 1/1958 Catalano ..... 383/96
3,025,989 A * 3/1962 Williams ..... 215/252

(Continued)

FOREIGN PATENT DOCUMENTS

CN 2626482 Y 7/2004
CN 2829729 Y 10/2006

(Continued)

OTHER PUBLICATIONS

Translation of WO 2006/042579 (Brandenburger et al.) Apr. 27, 2006, Paragraphs 17, 18, and 41.*

(Continued)

*Primary Examiner* — Robert J Hicks
(74) *Attorney, Agent, or Firm* — Panitch Schwarze Belisario & Nadel LLP

(57) ABSTRACT

A closure (2) for a container for pharmaceuticals, in particular a sterile container, includes a closure body (2) that is prefabricated from a non-elastic material. The container has a crucible shape with a bottom (3) and a wall (4, 5). At least one piercable opening (8) is incorporated in the bottom (3) of the crucible-shaped closure body (2) and provided for adding or removing liquid pharmaceuticals. The piercable opening (8) is sealed by a sealing element (7). The sealing element (7) is held in a receptacle (12), which is formed by the bottom (3) and a holding element (11) protruding toward the inside in the use position of the closure (1).

22 Claims, 5 Drawing Sheets

(56) References Cited

U.S. PATENT DOCUMENTS

| | | | | |
|---|---|---|---|---|
| 4,512,486 | A * | 4/1985 | Kobayashi et al. | 215/249 |
| 5,288,560 | A * | 2/1994 | Sudo et al. | 428/494 |
| 5,598,938 | A * | 2/1997 | Rizzardi | 215/249 |
| 5,718,348 | A | 2/1998 | Manera | |
| 6,050,435 | A * | 4/2000 | Bush et al. | 215/250 |
| 6,223,918 | B1 | 5/2001 | Browne | |
| 7,097,057 | B2 | 8/2006 | Classens | |
| 7,137,519 | B2 | 11/2006 | Becker | |
| 2004/0112855 | A1 * | 6/2004 | Becker | 215/247 |
| 2006/0138069 | A1 * | 6/2006 | Domkowski et al. | 215/247 |
| 2007/0183937 | A1 | 8/2007 | Sarstedt | |

FOREIGN PATENT DOCUMENTS

| | | | | |
|---|---|---|---|---|
| DE | 3835720 | A1 | 5/1990 | |
| DE | 4340910 | C1 | 1/1995 | |
| DE | 29710136 | U1 | 8/1997 | |
| DE | 19962664 | A1 | 7/2001 | |
| DE | 20204684 | U1 | 5/2002 | |
| DE | 10127823 | C1 | 8/2002 | |
| DE | 202006001995 | U1 | 6/2006 | |
| WO | WO 2006042579 | A1 * | 4/2006 | B65D 51/00 |
| WO | WO 2007073055 | A1 * | 6/2007 | B65D 51/28 |
| WO | 2009095488 | A1 | 8/2009 | |

OTHER PUBLICATIONS

Int'l Search Report issued Mar. 11, 2010 in Int'l Application No. PCT/EP2009/008677.

Int'l Preliminary Report on Patentability issued Oct. 22, 2010 in Int'l Application No. PCT/EP2009/008677.

Office Action issued Oct. 7, 2009 in German Application No. 10 2008 060 995.1-27.

English translation of the Office Action issued Jun. 20, 2013 in CN Application No. 200980147638.5.

* cited by examiner

PRIOR ART
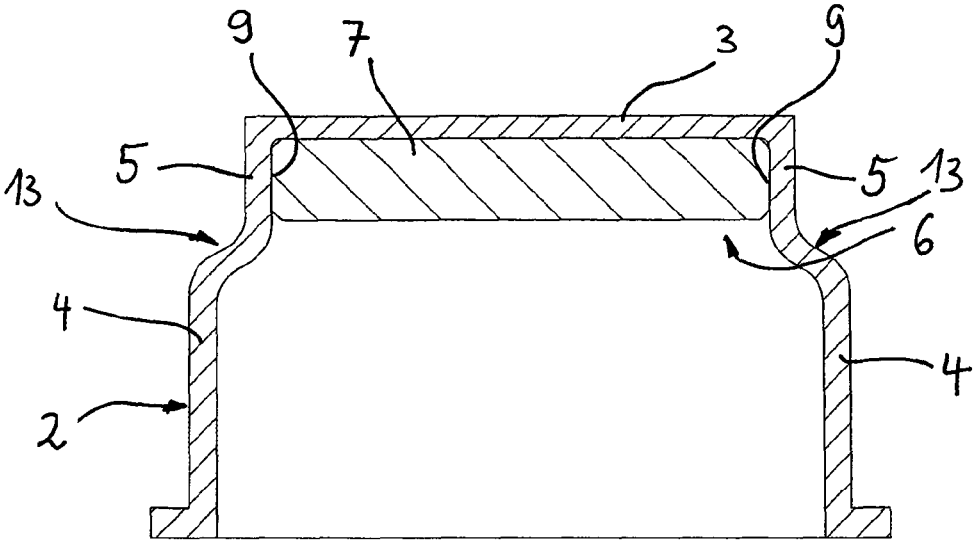
Fig. 1
PRIOR ART
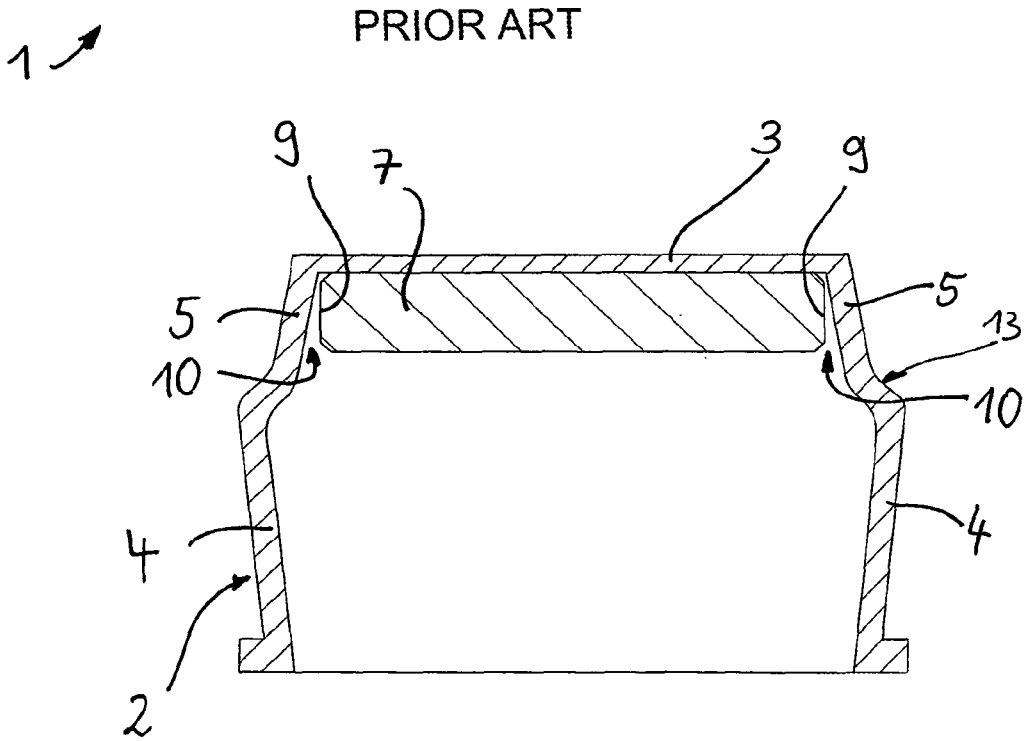
Fig. 2
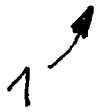

PRIOR ART

CLOSURE FOR A CONTAINER FOR PHARMACEUTICALS

CROSS-REFERENCE TO RELATED APPLICATIONS

This application is a Section 371 of International Application No. PCT/EP2009/008677, filed Dec. 4, 2009, which was published in the German language on Jun. 17, 2010, under International Publication No. WO 2010/066382 A1 and the disclosure of which is incorporated herein by reference.

BACKGROUND OF THE INVENTION

The present invention relates generally to a closure for a preferably sterile pharmaceutical container, wherein the closure has a prefabricated closure body, which has a cup-shaped construction having a base and a wall, wherein the closure body has, in the base of its cup shape, at least one pierceable opening, and wherein an elastically pliant sealing element is arranged on this closure body in the region of the base of its cup shape, such that the at least one pierceable opening is closed by the sealing element and a part of the sealing element is accessible from the outside in the use position of the closure.

Closures are known, for example, from DE 38 35 720 A1, wherein the closures described there are manufactured such that, initially a closure body is produced in the form of a cap, and the elastically pliant sealing element is injection molded into the cap in a further production step in the same mold or a part of this mold. These closures have proven themselves in practice.

It has been shown that such prior art closures are exposed to strong deformation forces in wide areas in the course of further processing, especially during assembly on the pharmaceutical container, which can be a bottle, for example, and during the subsequent heat treatment for sterilization, the autoclaving process, wherein these strong deformation forces can negatively affect a reliable retention of the sealing element and possibly its original biasing. Therefore, up until now, a post-inspection of the completely assembled closure and/or an increased expense for the connection of the sealing element to the closure body have been necessary.

For example, in DE 38 35 720 A1 it is provided that the sealing element is injection molded into the closure body, wherein a large surface area connection region between the sealing element and closure body is produced and the pharmaceutical bottle closed by the closure has, at its bottle opening, a bottle cover connected integrally to the pharmaceutical bottle, wherein, in the unused state, the sealing element forms a sealing contact on the bottle cover and is at least partially supported by this. However, the production of such an arrangement requires a complicated mold.

BRIEF SUMMARY OF THE INVENTION

The present invention is based on the objective of creating a closure for an especially sterile pharmaceutical container, in which the retention of the sealing element on the closure cap is improved.

To achieve the above objective in a closure of the type described above, it is provided that the closure body has a retaining element independent of the wall of the cup shape of the closure body, wherein this retaining element projects inward from the base of the cup-shaped closure body in the use position of the closure, and wherein a receptacle for the sealing element is formed by the retaining element and the sealing element is arranged in the receptacle. Therefore, since the retaining element projects from the base of the cup-shaped closure body and is independent of the wall of the cup shape, the deformation forces described above and acting in the closure body are not transferred to the receptacle formed by the retaining element, whereby the fastening of the sealing element in the receptacle is not negatively affected. Thus, the retention of the sealing element on the closure body is improved.

The closure body can be made of non-elastic material, for example a hard plastic.

Before use, the pierceable openings can be closed from the outside by removable covers.

Preferably, the base has a flat or planar construction. However, a base that is curved outwardly or inwardly can be used instead.

The pharmaceutical container can be, for example, a bottle or a bag or a general container for preferably liquid pharmaceuticals. During use, the pharmaceutical container is often positioned or hung upside down, so that the base of the cup shape of the closure body is arranged under its wall.

An especially good decoupling of the retaining element from the deformation forces, introduced into the closure body by thermal loading of the closure body, is achieved when the retaining element is spaced apart from the wall of the cup shape of the closure body and forms an intermediate space with this wall at least in some sections, preferably across the entire extent of the retaining element on the base of the cup shape.

The retaining element can be made of several individual parts, which interact for accommodating the sealing element, or the retaining element can be constructed integrally. It is especially favorable when the retaining element describes a contour, which surrounds the at least one pierceable opening along the base. The retaining element thus can introduce a biasing stress on the sealing element arranged in the receptacle, which is directed onto the relevant pierceable opening.

For the most complete possible decoupling of the retaining element from the wall, it can be provided that the intermediate space formed by the retaining element and the wall of the cup shape of the closure body extends across the entire length of the contours.

It can be provided that the retaining element penetrates the sealing element and/or that the retaining element contacts a periphery of the sealing element at least in some sections along the contour. Thus, the sealing element can be held on the closure body by the retaining element from several sides, preferably on all sides with respect to the base of the closure body.

For example, it can be provided that the retaining element has ribs, which contact the sealing element being used and which are oriented transverse to the direction of extent of the periphery of the sealing element. Through the construction of ribs, an even more improved stability of the retaining element is achieved relative to deformation forces that are introduced into the closure body.

Alternatively or additionally, it can be provided that the retaining element is constructed as a wall. A construction of the retaining element as a web can also be provided.

For example, it can be provided that the retaining element has segments, which are each adapted to a section of the periphery of the sealing element. These segments consequently follow the periphery of the sealing element and contact the sealing element in these sections.

Here it is especially favorable when these segments are connected to each other and the retaining element thus contacts the sealing element along the entire periphery of the sealing element. The retaining element can be constructed, for example, as a continuous wall or as a continuous web.

For an especially cost-effective production of the closure, it can be provided that the retaining element is constructed integrally with the closure body.

In one preferred embodiment of the present invention, it can be provided that the sealing element is held in the receptacle with a biasing stress. Here, it is advantageous that a pierced hole, formed in the sealing element with a cannula or needle during use, can be automatically closed after use by the biasing stress of the sealing element.

For a cost-effective production of the closure, it can be provided that the sealing element is produced from rubber material or from TPE material.

The closure body can be produced, for example, from a thermoplastic material, that is a meltable plastic.

For example, it can be provided that the sealing element is injection molded into the receptacle or that the sealing element is prefabricated and inserted into the receptacle.

Favorable properties of use of the closure are achieved when the closure body has, in the base of its cup shape, at least two pierceable openings, which are closed by the sealing element or each by a sealing element, wherein a part of one sealing element or of the sealing element is accessible through each pierceable opening in the use position of the closure. For example, one pierceable opening can be used for introducing a pharmaceutical into a diluting solution, while the other pierceable opening can be provided for removing the now diluted pharmaceutical.

These pierceable openings can be arranged in a common plane.

According to one preferred embodiment of the present invention, it can be provided that the retaining element describes a contour, which jointly surrounds the at least two pierceable openings. Thus, it is advantageously achieved that the retaining element forms a receptacle in which a sealing element can be arranged for both pierceable openings.

According to one preferred embodiment of the present invention, it can be provided that the retaining element forms, in a region between the at least two pierceable openings, a narrowing in the receptacle for the sealing element. Here, it is advantageous that through this narrowing, a biasing stress can also be introduced onto the sealing element, whose force component runs essentially parallel to the line connecting the pierceable openings. Thus, a biasing stress essentially on all sides is produced in the sealing element in the areas of the pierceable openings. It is further advantageous that material of the sealing element can be spared due to the narrowing. The retaining element thus can describe an eyeglass-shaped or figure eight contour, which is defined by the twin arrangement of the circular pierceable openings.

Alternatively, it can be provided that a separate receptacle for a sealing element is constructed by the retaining element on each pierceable opening of the closure body. These sealing elements can be connected to each other integrally outside of each receptacle.

For an even more improved retention of the sealing element on the closure body, it can be provided that the at least one sealing element is connected to the closure body with a force fit, for example by clamping due to the biasing stress, and/or with a form fit, for example by an undercut section on the retaining element, and/or with a material fit, for example by injection molding, adhesion, or welding.

For an especially rigid retention of the sealing element on the base of the closure body, it can be provided that the base of the cup shape of the closure, especially in the region of the edge of the pierceable opening or openings, outwardly covers a part of the sealing element in the use position of the closure. Preferably, it can be provided that the retaining element maintains a minimum distance from the pierceable opening, especially from the periphery or the edge of the pierceable opening.

With one preferred embodiment of the present invention it can be provided that the sealing element is bordered on the end side by the base in a region adjacent to the at least one pierceable opening. It is advantageous here that a bulging of the sealing element is avoided when the cap expands. It is especially favorable when the region encloses or borders the pierceable opening.

With one preferred embodiment of the present invention it can be provided that the sealing element is arranged spaced apart from the wall in the axial direction. It is advantageous here if the sealing element is mechanically decoupled from the wall, so that expanding or stress-relieving deformation forces, which are applied by the wall under thermal treatment, for example, are transmitted not at all or only to a reduced degree onto the sealing element.

The present invention can be applied advantageously in an infusion container, in which the closure of the infusion container is constructed according to the invention.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 1 is a section view of a closure according to the prior art;

FIG. 2 is a section view of the closure of FIG. 1 after thermal loading;

DETAILED DESCRIPTION OF THE INVENTION

Figure 3:
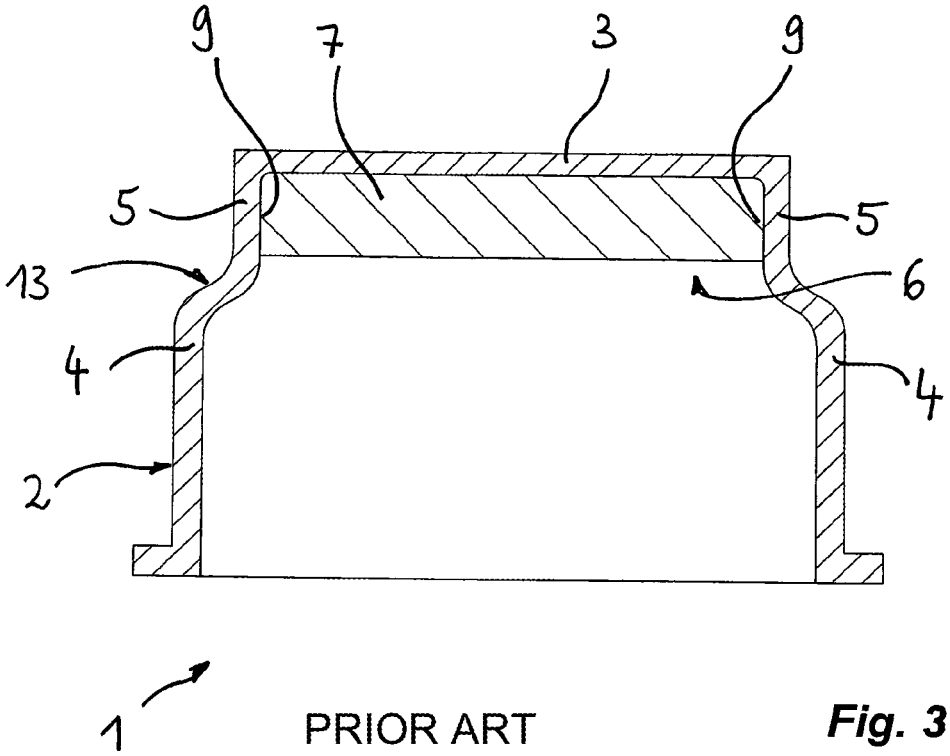
PRIOR ART Fig. 3
FIG. 3 is a section view of another closure according to the prior art.

Certain terminology is used in the following description for convenience only and is not limiting. The word "bottom" designates a direction in the drawings to which reference is made. The words "inwardly" and "outwardly" refer to directions toward and away from, respectively, the geometric center of the device, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

FIG. 1 shows in a section view a closure designated overall with 1 for a sterile pharmaceutical container according to the prior art, wherein the section plane is selected so that it stands transverse to the plane defined by the opening of the pharmaceutical container.

The closure 1 has a closure body 2 made of a hard, that is non-elastic, material. This closure body 2 forms a cup shape with a flat or planar base 3 and a wall 5 adjacent to the base 3.

Another wall 4 adjoins the wall 5. The wall 5 has a diameter retracted relative to the wall 4, whereby a shoulder 13 is formed between wall 4 and wall 5.

The base 3 and the wall 5 form a receptacle 6 for a sealing element 7 made of TPE material.

Figure 7:
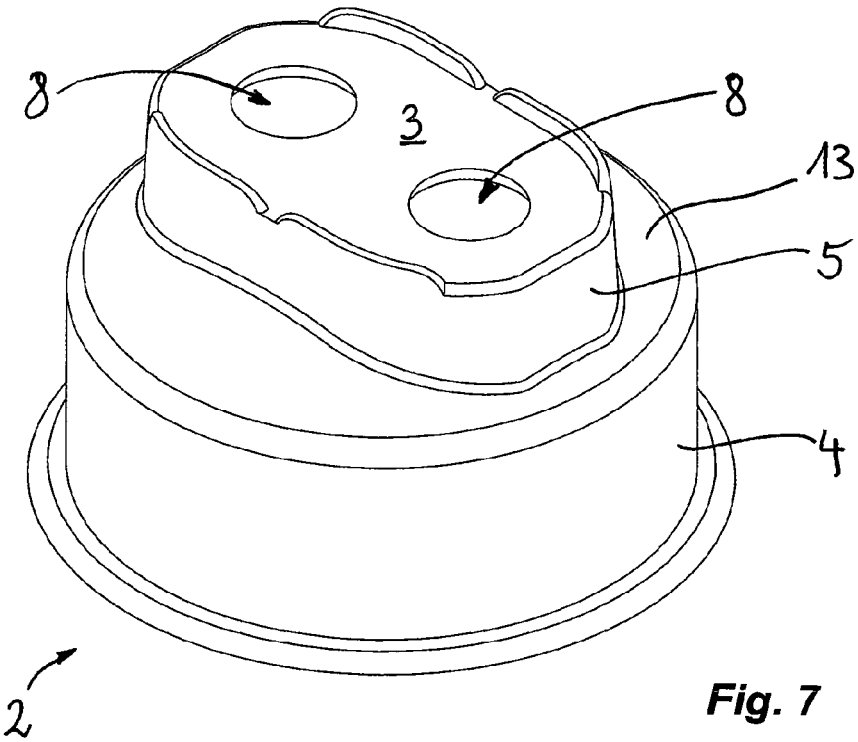
FIG. 7 is a perspective view from outside of the closure of FIG. 5.

The sealing element 7 seals, from the inside, pierceable openings 8, constructed as in the preferred embodiment according to FIG. 7 and not further visible in FIG. 1. Here, the part of the sealing element 7 lying behind the pierceable openings 8 is accessible from the outside in the use position of the closure 1.

In this way, fluids can be put into the pharmaceutical container or taken out from this container, in that a cannula or needle or the like is guided through the pierceable opening 8 and the sealing element 7 arranged behind the opening.

In order to maintain the sterility of the pharmaceutical container, it is desirable that the hole remaining in the sealing element 7 after removal of the cannula or needle or the like is automatically closed again. This is achieved in that the sealing element 7 is arranged in the receptacle 6 under a biasing stress.

For the production of the pharmaceutical container and especially for connecting the closure 1 to a pharmaceutical container, not shown further, it is necessary to heat the closure. Through this thermal loading, deformation forces are introduced into the closure body 2, which lead to a deformation of the closure body 2.

FIG. 2 shows an example section view through such a deformed closure 1.

It is obvious that the deformation has led to a change in the diameter of the wall 5 and the wall 4, while the flat base 3 of the cup shape of the closure body 2 is left essentially unchanged.

This deformation of the wall 5 leads to the fact that—as is visible from FIG. 2—between the periphery 9 of the sealing element 7 and the wall 5, an annular gap 10 opens up, so that the sealing element 7 is no longer held by the wall 5 of the cup-shaped closure body 2.

Thus, there is the risk that the sealing element 7 will break free during the piercing with a cannula from the base 3 of the cup shape of the closure body 2, whereby the sterility of the interior of the pharmaceutical container is no longer guaranteed.

FIG. 3 shows another closure 1 known from the prior art, which is built essentially like the closure 1 according to FIG. 1, wherein, however, for improving the retention of the sealing element 7 in the closure body 2, the sealing element 7 is connected at its periphery 9 to the wall 5 with a material fit.

Through this connection, the formation of a gap 10 as in FIG. 2 is prevented in the case of thermal deformation of the closure 1.

Figure 4:
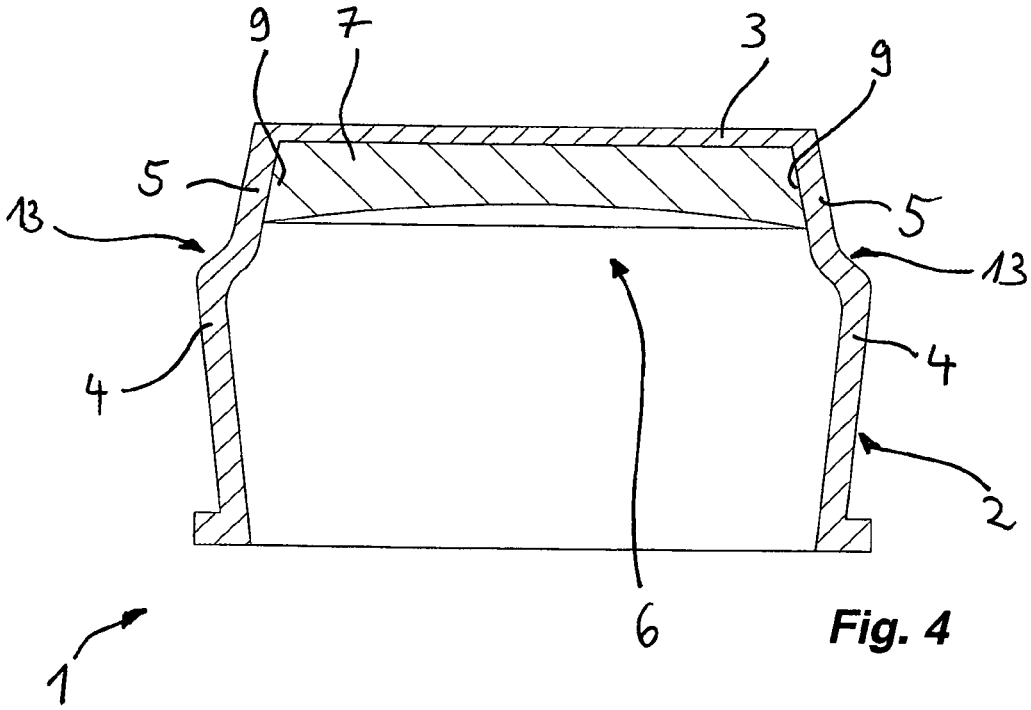
FIG. 4 is a section view of the closure of FIG. 3 after thermal loading.

With this closure 1, however, the deformation forces are introduced via the wall 5 onto the sealing element 7, whereby this is set in tension in the region of the pierced openings 8 and deforms accordingly (as shown in FIG. 4).

This deformation has the result that a biasing stress is lost and thus an automatic closing of pierced channels in the sealing element 7 is no longer guaranteed.

Figure 5:
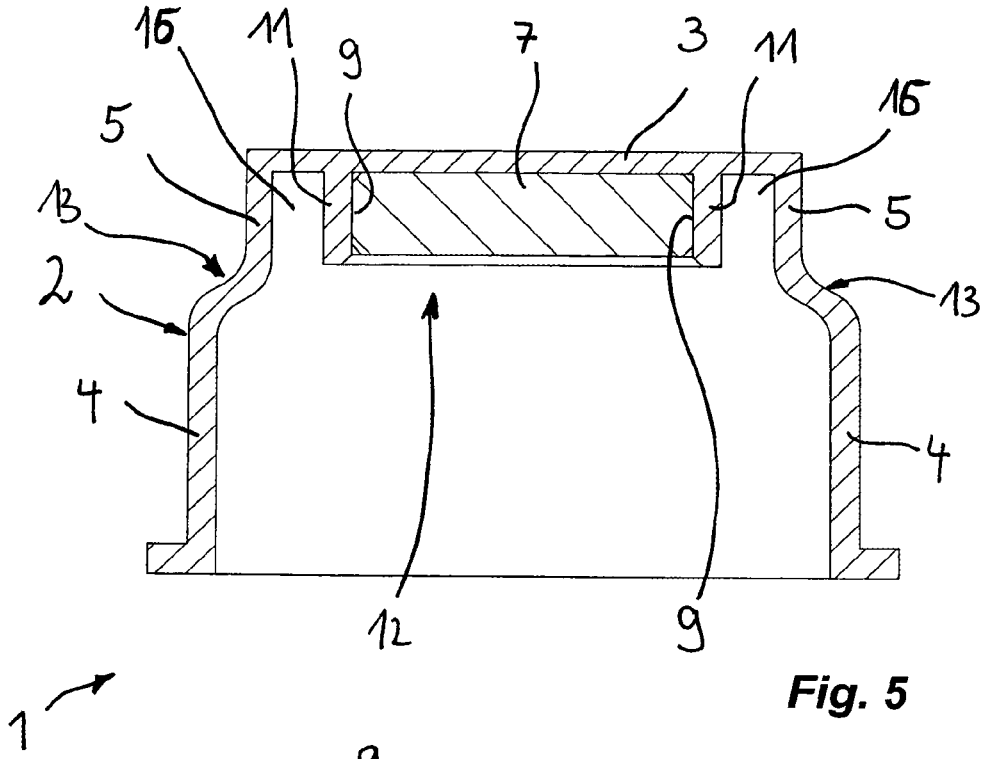
FIG. 5 is a section view of a closure according to a preferred embodiment of the present invention.

FIG. 5 shows a preferred embodiment according to the present invention of a closure 1 in a section view, wherein the section plane is selected as in FIGS. 1-4.

The closure 1 according to FIG. 5 also has a prefabricated, hard closure body 2. This closure body 2 made of a thermoplastic, non-elastic material has—as is clear by comparison with FIG. 7—an oval cup shape with a planar or flat base 3 and a wall 5 adjoining this base 3. Another wall 4 of a basic cylindrical shape adjoins the wall 5 via a shoulder 13. The closure 1 offers the same outer appearance as the closures according to FIGS. 1-4.

On its inner side facing the interior of the pharmaceutical container in the use position, the closure body 2 has additionally a retaining element 11, by which a receptacle 12 is formed for the sealing element 7.

For this purpose, the retaining element 11 projects inwardly from the base 3 of the cup-shaped closure body 2.

The sealing element 7 is produced from an elastically pliant material and closes two pierceable openings 8, which are visible in detail in FIG. 7 and are constructed in the base 3 of the closure body 2. The sealing element 7 is produced, for example, from TPE material. A sealing element 7 made of rubber or another elastic material is also usable.

Figure 6:
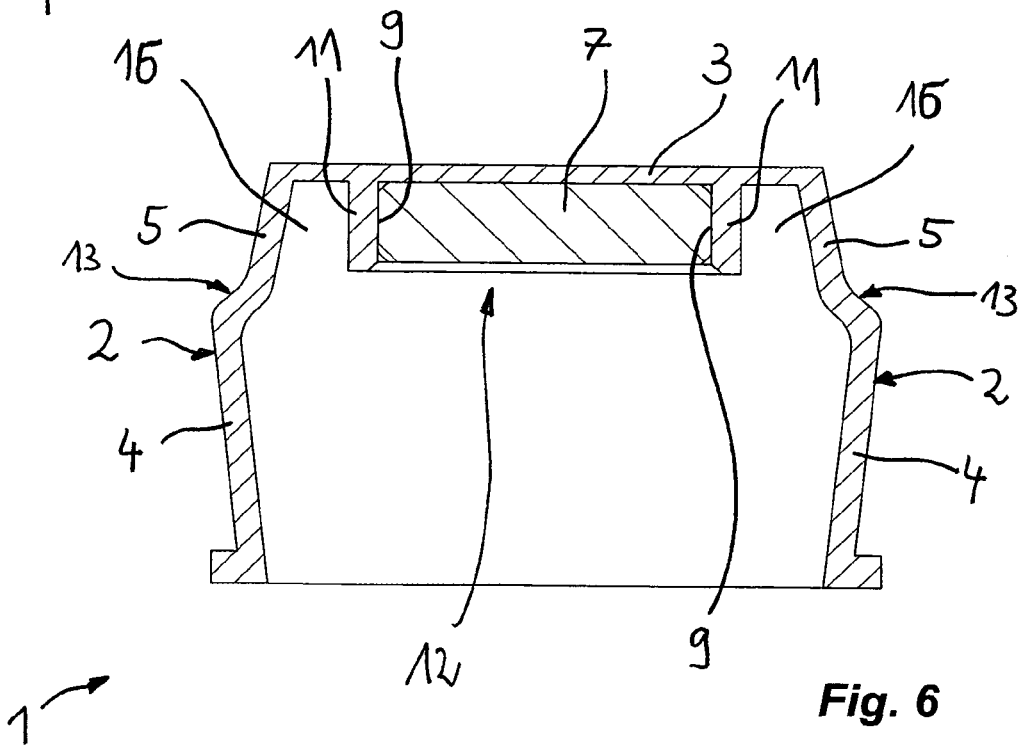
FIG. 6 is a section view of the closure of FIG. 5 after thermal loading.

FIG. 6 shows an example section view through the closure 1 according to FIG. 5 after deformation due to thermal loading.

Indeed—as in the examples according to FIGS. 1-4—the wall 4 and the wall 5 have expanded due to the deformation forces, but this deformation has not been transmitted to the retaining elements 11, which is why the receptacle 12 formed by the retaining elements 11 projecting from the base 3 has not changed its shape. The seating and retention of the sealing element 7 in the receptacle 12 is thus not negatively affected by the thermal loading.

FIG. 7 shows a three-dimensional lateral view of the outside of the closure body 2.

It is clearly seen that the closure body 2 has a cup shape formed by the base 3 and the walls 4 and 5. The closure body 2 is set back in its diameter in the region of the wall 5 relative to the wall 4, whereby a shoulder 13 is formed. The base 3 and the shoulder 13 thus form end-side faces and are oriented in the axial direction, while the walls 4 and 5 form faces oriented in the radial direction.

The wall 5 with the base 3 thus projects like a cup from the shoulder 13.

In the base 3, two pierceable openings 8 are formed, through which cannulas or the like can be guided for filling or for removing fluids. The pierceable openings 8 are arranged in a twin arrangement.

For sealing the pierceable openings 8, a sealing element 7, not further visible in FIG. 7, is arranged behind these pierceable openings 8 and completely closes the pierceable openings 8. Here in the use position of the closure 1, the base 3 covers from the outside a part of the sealing element 7 in the region of the edge of the pierceable openings 8.

Figure 8:
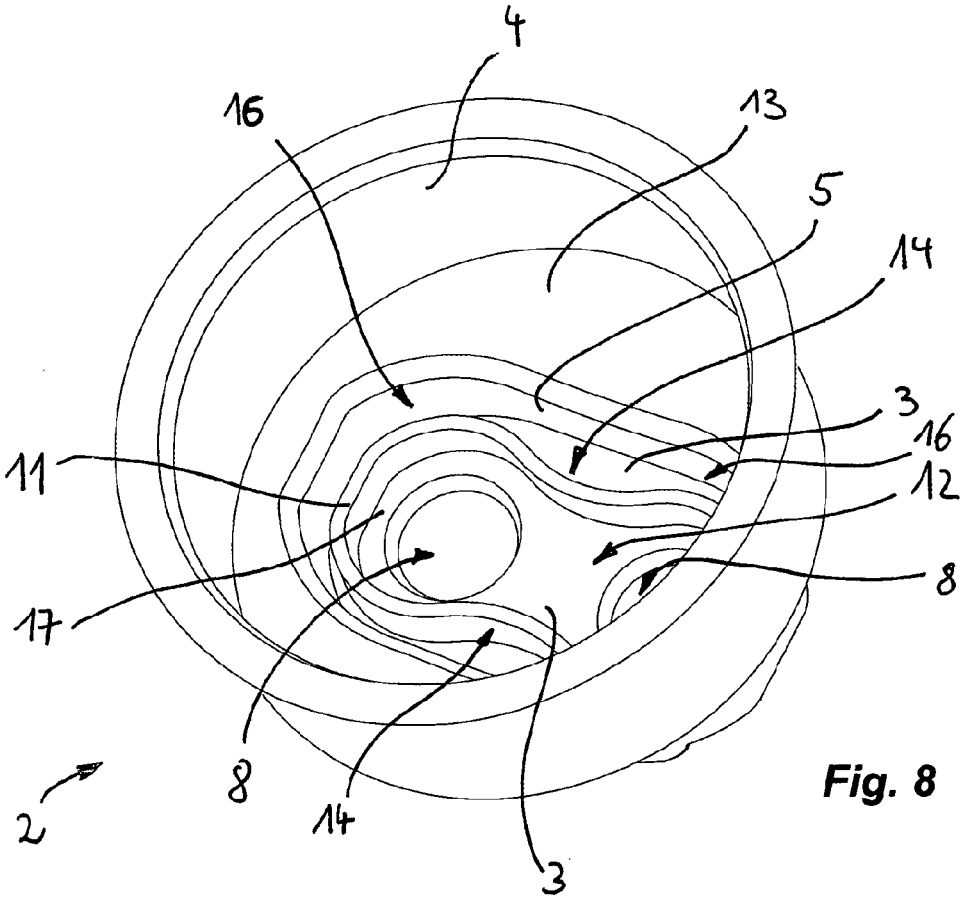
FIG. 8 is a perspective view of an inside of the closure of FIG. 5.

FIG. 8 shows a three-dimensional view of the inner-lying part of the closure cap 2 in the use position of the closure 1.

It is evident that the wall 4 with the shoulder 13 forms another cup shape, wherein the shoulder 13 represents the base of this additional cup shape. The first cup shape formed from base 3 and wall 5 opens into this base.

The retaining element 11 projects from the base 3 and thus forms with the base 3 a receptacle 12 for the sealing element 7, which is not visible in FIG. 8.

The retaining element 11 is constructed as a wall and describes a contour, which jointly surrounds the pierceable openings 8. The base 3 extends on both sides of the retaining element 11, whereby, in the region of the edge of the pierceable openings 8, a part of the sealing element 7 arranged in the receptacle 12 is covered on the outside.

The retaining element 11 maintains a minimum distance 17 from the pierceable openings 8. Since the retaining element 11 has an eyeglasses-shaped profile around the two pierceable openings 8, the spacing of the retaining element 11 from the pierceable openings 8 in the region between the pierceable openings 8 is greater than the minimum distance 17. Through this minimum distance 17, for each pierceable opening 8, a region of the base 3 surrounding and bordering the pierceable opening 8 is formed, which borders the sealing element 7 on the end side to the outside in the use position in the receptacle 12, so that it cannot fall out or bulge outwardly.

The contour describing the retaining element 11 is selected to fit the dimensions of the sealing element 7.

The inserted or injection-molded sealing element 7 thus comes in touching contact with the retaining element 11 along its entire periphery 9. The retaining element 11 thus contacts and holds the sealing element 7 at these contact points.

The retaining element 11 is constructed integrally with the closure body 2 as walls projecting from the base 3.

The retaining element 11 is spaced apart from the wall 5 along the contour described by the retaining element 11 and thus forms an intermediate space 16 with the wall 5. Retaining element 11 and wall 5 thus enclose the intermediate space 16. This intermediate space 16 serves for compensating the deformation forces in the closure body 2, whereby the resulting deformation has no effect on the shape of the retaining element 11. The intermediate space 16 extends across the entire length of the contour described by the retaining element 11.

Through the retaining element 11, a narrowing 14 is formed in the region of the receptacle 12, which is arranged between the pierceable openings 8. This narrowing 14 has the effect that a force component can be introduced onto the sealing element 7 in the region of the pierceable openings 8 via a biasing stress, wherein this force component runs essentially parallel to the line connecting the center points of the pierceable openings 8 or encloses, with this line, an acute angle, preferably of less than 45°.

The sealing element 7 is connected in the receptacle 12 to the closure body 2 with a force fit, because due to the biasing stress of the sealing element 7, the static friction between the periphery 9 of the sealing element and the retaining element 11 is increased.

Figure 9:
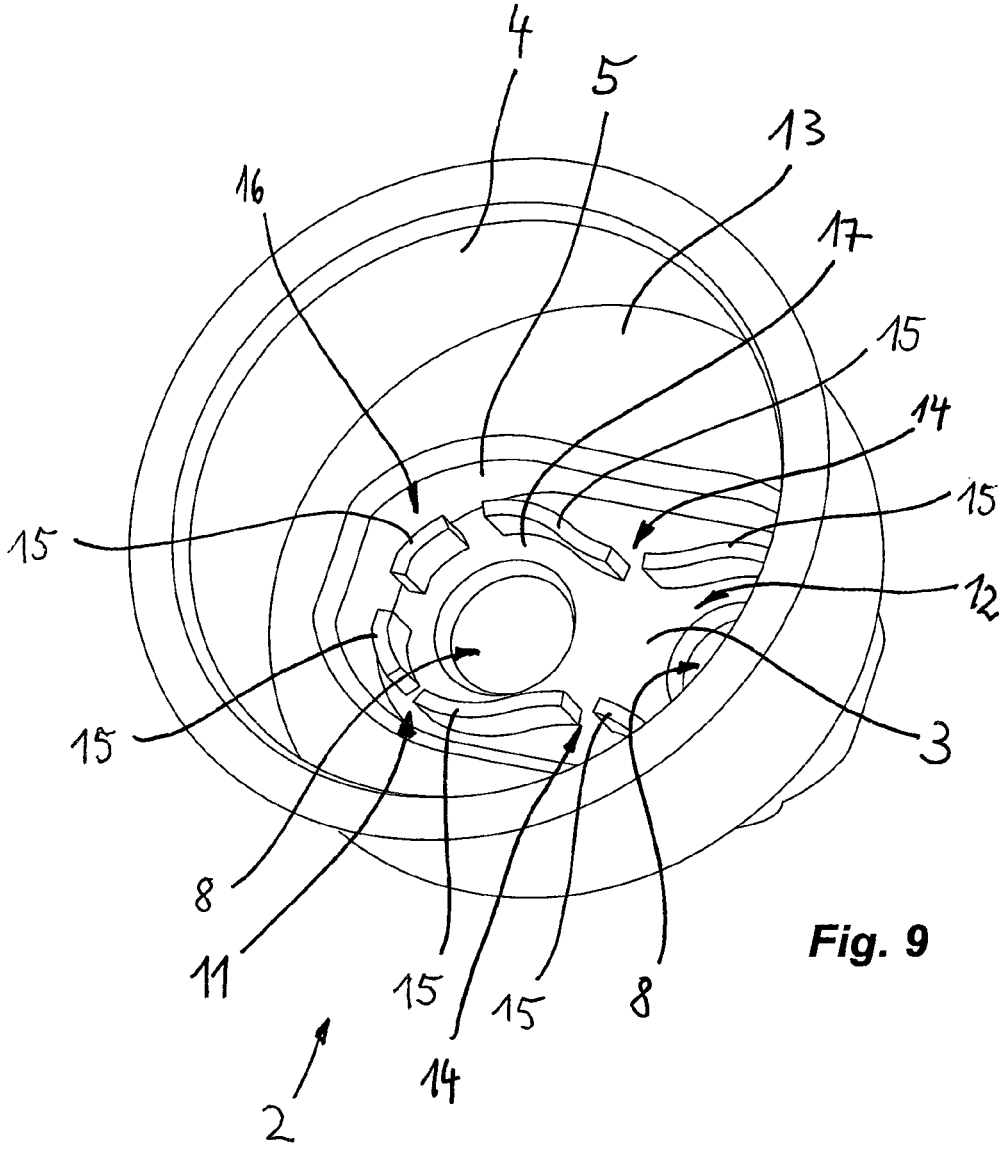
FIG. 9 is a perspective view of the inside of another closure according to a preferred embodiment of the present invention.

FIG. 9 shows another preferred embodiment of a closure cap 2 according to the present invention. The closure body 2 according to FIG. 9 differs from the closure body 2 according to FIG. 8 in that the retaining element 11 is formed from several separate segments 15, which jointly describe a contour surrounding the two pierceable openings 8.

If a prefabricated sealing element 7 is inserted into the receptacle 12 formed by the retaining element 11 and the base 3, then the individual segments 15 of the retaining element 11 contact a section of the periphery 9 of the sealing element 7. For this purpose, the segments 15 are adapted to their shape at one section of the periphery 9 of the sealing element 7.

The contour described by the retaining element 11 jointly surrounding the pierceable openings 8 is identical with the contour of the retaining element 11 according to FIG. 8. Thus, the retaining element 11 likewise forms a narrowing 14 in the region of the receptacle 12 between the pierceable openings 8 for the previously described purpose. For this preferred embodiment also, the contour and thus the segments 15 maintain a minimum distance 17 to the pierceable openings 8 that is greater than zero. Through this minimum distance 17, for each pierceable opening 8, a region surrounding and bordering the pierceable opening 8 is formed by the base 3, which borders the sealing element 7 in the use position in the receptacle 12 at the end at the outside, so that it cannot fall out or bulge outwardly.

With the preferred embodiment according to FIG. 9 also, the retaining element 11 is arranged spaced from the wall 5 of the cup-shaped closure body 2, whereby respective intermediate spaces 16 are formed between the segments 15 and the wall 5. By the spacing, the segments 15 are decoupled from movements of the wall 5, for example thermal deformations, and deformation forces in the closure body 2 are essentially not transmitted to the retaining element 11 and therefore do not lead essentially to a change in shape of the receptacle 12. Thus, the sealing element 7 in this embodiment also is then held securely on the closure body 2 and then maintains its biasing stress when the rest of the deformation body 2 deforms.

By spacing the retaining element 11 from the wall 5, the retaining element 11 is constructed independent of the wall 5.

If the sealing element 7 is injection molded in the receptacle 12, then material of the sealing element 7 reaches through the gaps between the segments 15 even in the region between the holding element 11 and the wall 5. In this case, the segments 15 of the retaining element 11 penetrate the sealing element 7.

The existence of a contact between sealing element 7 and the wall 5 is, however, not required for the retention of the sealing element 7 in the receptacle 12, because the retaining forces and the forces required for the application of a biasing stress are applied through the segments 15 of the retaining element 11. Such a contact can be lost even with unavoidable thermal deformations of the closure body 2, without the fastening of the sealing element 7 on the base 3 being negatively affected.

For the closure 2 for an especially sterile pharmaceutical container, a closure body 2 prefabricated from a non-elastic material has a cup shape with a base 3 and a wall 4, 5. In the base 3 of the cup shape of the closure body 2 at least one pierceable opening 8 is introduced, which is provided for the addition or removal of liquid pharmaceuticals. This pierceable opening 8 is sealed by a sealing element 7. The sealing element 7 is held in a receptacle 12, which is formed by the base 3 and a retaining element 11 projecting inwardly from this base 3 in the use position of the closure 1.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A closure for a sterile pharmaceutical container, the closure (1) being thermally deformable by heating for connecting to the pharmaceutical container, the closure (1) comprising a prefabricated closure body (2) having a cup-shaped construction with a base (3) having an exterior surface and an opposing interior surface, a wall (5) depending downwardly from the interior surface of the base (3), a shoulder (13) extending from the wall (5) and another wall (4) depending downwardly from the shoulder (13), the closure body (2) having at least one pierceable opening (8) in the base (3), an elastically pliant sealing element (7) being arranged on the closure body (2) in the region of the base (3) such that the at least one pierceable opening (8) is sealed by the sealing element (7) and a part of the sealing element (7) is accessible from outside in a use position of the closure (1), the closure body (2) having a retaining element (11) independent of the wall (5) and projecting inwardly from the interior surface of the base (3) of the closure body (2) in the use position of the closure (1), an entire outer periphery of the retaining element (11) being radially spaced-apart from the wall (5), wherein the entire interior surface of the base (3) positioned radially outwardly of the retaining element (11) extends generally in a single common plane with the entire interior surface of the base (3) positioned radially inwardly of the retaining element (11), wherein a receptacle (12) is formed by the retaining element (11) for the sealing element (7) and the sealing element (7) is arranged in the receptacle (12).

2. The closure according to claim 1, wherein the retaining element (11) is spaced from the wall (5) of the closure body (2) and forms an intermediate space (16) with the wall at least in some sections.

3. The closure according to claim 2, wherein the retaining element (11) has a contour that surrounds the at least one pierceable opening (8) along the base (3).

4. The closure according to claim 3, wherein the intermediate space (16) formed by the retaining element (11) and the wall (5) of the closure body (2) extends across the entire length of the contour.

5. The closure according to claim 3, wherein the retaining element (11) contacts a periphery (9) of the sealing element (7) along the contour at least in some sections.

6. The closure according to claim 5, wherein the retaining element (11) has ribs which contact the sealing element (7) and are oriented transverse to a direction of extension of the periphery (9) of the sealing element (7).

7. The closure according to claim 1, wherein the retaining element (11) is constructed as a wall.

8. The closure according to claim 5, wherein the retaining element (11) has segments (15) adapted to a section of the periphery (9) of the sealing element (7).

9. The closure according to claim 5, wherein the retaining element (11) contacts the sealing element (7) along the entire periphery (9) of the sealing element (7).

10. The closure according to claim 1, wherein the retaining element (11) is constructed integrally with the closure body (2).

11. The closure according to claim 1, wherein the sealing element (7) is held in the receptacle (12) with biasing stress.

12. The closure according to claim 1, wherein the sealing element (7) is produced from rubber material or from TPE material.

13. The closure according to claim 1, wherein the sealing element (7) is injection molded in the receptacle (12) or the sealing element (7) is prefabricated and is inserted into the receptacle (12).

14. The closure according to claim 1, wherein the closure body (2) has in the base (3) at least two pierceable openings (8) which are closed by the sealing element (7), wherein a part of the sealing element (7) is accessible through each pierceable opening (8) in the use position of the closure (1).

15. The closure according to claim 14, wherein the retaining element (11) has a contour which jointly surrounds the at least two pierceable openings (8).

16. The closure according to claim 14, wherein the retaining element (11) forms a narrowing (14) in the receptacle (12) for the sealing element (7) in a region between the at least two pierceable openings (8).

17. The closure according to claim 16, wherein a separate receptacle (12) is constructed for the sealing element (7) by the retaining element (11) at each pierceable opening (8) of the closure body (2).

18. The closure according to claim 1, wherein the sealing element (7) is connected to the closure body (2) with at least one of a force fit, a form fit and a material fit.

19. The closure according to claim 1, wherein the base (3) of the closure (1) covers a part of the sealing element (7) on the outside in the use position of the closure (1).

20. The closure according to claim 1, wherein the sealing element (7) is bordered on an end side by the base (3) in a region (17) adjacent to the at least one pierceable opening (8) and surrounding or bordering the pierceable opening (8).

21. The closure according to claim 1, wherein the sealing element (7) is arranged spaced from the wall (5) in an axial direction.

22. An infusion container having a closure, the closure (1) being thermally deformable by heating for connecting to the pharmaceutical container, the closure (1) comprising a prefabricated closure body (2) having a cup-shaped construction with a base (3) having an exterior surface and an opposing interior surface, a wall (5) projecting downwardly from the interior surface of the base (3), the closure body (2) having at least one pierceable opening (8) in the base (3), an elastically pliant sealing element (7) being arranged on the closure body (2) in the region of the base (3) such that the at least one pierceable opening (8) is sealed by the sealing element (7) and a part of the sealing element (7) is accessible from outside in a use position of the closure (1), the closure body (2) having a retaining element (11) independent of the wall (5) and projecting inwardly from the interior surface of the base (3) of the closure body (2) in the use position of the closure (1), the retaining element (11) projecting inwardly from the interior surface of the base (3) approximately the same distance the wall (5) projects downwardly from the interior surface of the base (3), wherein the entire interior surface of the base (3) positioned radially outwardly of the retaining element (11) extends generally in a single common plane with the entire interior surface of the base (3) positioned radially inwardly of the retaining element (11), wherein a receptacle (12) is formed by the retaining element (11) for the sealing element (7) and the sealing element (7) is arranged in the receptacle (12).

* * * * *